US010534294B2

(12) United States Patent
Oshima

(10) Patent No.: US 10,534,294 B2
(45) Date of Patent: Jan. 14, 2020

(54) CARTRIDGE HAVING CLEANING MEMBER AND IMAGE FORMING APPARATUS INCLUDING SAME

(71) Applicant: CANON KABUSHIKI KAISHA, Tokyo (JP)

(72) Inventor: Nobuo Oshima, Inagi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/054,437

(22) Filed: Aug. 3, 2018

(65) Prior Publication Data

US 2019/0041776 A1 Feb. 7, 2019

(30) Foreign Application Priority Data

Aug. 7, 2017 (JP) ..... 2017-152667

(51) Int. Cl.

| | |
|---|---|
| ***G03G 15/20*** | (2006.01) |
| ***G03G 15/08*** | (2006.01) |
| ***G03G 15/02*** | (2006.01) |
| ***G03G 15/00*** | (2006.01) |
| ***G03G 21/18*** | (2006.01) |

(52) U.S. Cl.

CPC ..... *G03G 15/2025* (2013.01); *G03G 15/0225* (2013.01); *G03G 15/0258* (2013.01); *G03G 15/0872* (2013.01); *G03G 15/2053* (2013.01); *G03G 21/1814* (2013.01); *G03G 15/757* (2013.01)

(58) Field of Classification Search

CPC ..... G03G 15/2025; G03G 15/0225; G03G 15/0258

See application file for complete search history.

(56) References Cited

U.S. PATENT DOCUMENTS 5,765,076 A * 6/1998 Ogata ..... G03G 15/0225 399/100
2004/0258431 A1* 12/2004 Suzuki ..... G03G 15/0225 399/103

(Continued)

FOREIGN PATENT DOCUMENTS

| | | | |
|---|---|---|---|
| JP | H02272589 | A | 11/1990 |
| JP | H0862948 | A | 3/1996 |
| JP | 2011133690 | A | 7/2011 |

*Primary Examiner* — Sandra Brase

(74) *Attorney, Agent, or Firm* — Rossi, Kimms & McDowell LLP

(57) ABSTRACT

A cartridge is detachably provided to a main body of an image forming apparatus. The cartridge includes an image bearing member which is rotatable, a charging roller which contacts and charges the image bearing member, and a cleaning member which cleans the charging roller with the brush portion. In a section substantially orthogonal to a rotational axis of the charging roller, a contact point between a surface of the image bearing member and a tangent crossing a downstream end of an abutment region of the brush portion against the charging roller in a rotation direction of the charging roller among tangents to the image bearing member is vertically above a horizontal line passing through a center of the image bearing member, and an upstream end of the abutment region in the rotation direction of the charging roller is vertically above the downstream end in the rotation direction.

16 Claims, 14 Drawing Sheets

(56) References Cited

U.S. PATENT DOCUMENTS

| | | | | |
|---|---|---|---|---|
| 2010/0054776 | A1* | 3/2010 | Mitsui | G03G 15/0225 399/50 |
| 2013/0058679 | A1* | 3/2013 | Shono | G03G 15/0225 399/100 |
| 2016/0259260 | A1* | 9/2016 | Ito | G03G 21/1803 |

* cited by examiner

H2
12
H1
18
a
R
10
11

12
11
a
R
10
B2
25

12
11
a
10
R
B2
J

FIRST EXAMPLE

FIRST COMPARATIVE
EXAMPLE

SECOND COMPARATIVE
EXAMPLE

THIRD COMPARATIVE
EXAMPLE

SECOND EXAMPLE

FIRST
COMPARATIVE
EXAMPLE

SECOND COMPARATIVE
EXAMPLE

CARTRIDGE HAVING CLEANING MEMBER AND IMAGE FORMING APPARATUS INCLUDING SAME

BACKGROUND OF THE INVENTION

Field of the Invention

The present invention relates to a cleaning member for cleaning a charging member in an image forming apparatus using electrophotographic process such as a copier and a laser printer.

Description of the Related Art

An electrophotographic image forming apparatus using electrophotographic image forming process uses a process cartridge system which includes, in an integral form, a photosensitive drum (hereinafter referred to as the "drum"), charging means for charging an upper surface of the drum, developing means, and cleaning means for cleaning the upper surface of the drum. Detachably providing the process cartridge to a main body of the image forming apparatus makes it easier for the user to carry out maintenance.

In recent years, a cleaner-less method has been proposed for the purpose of reducing the size of an image forming apparatus and a process cartridge (see Japanese Patent Application Publication No. H02-272589). According to the cleaner-less method, a residual developer (hereinafter referred to as "toner") on the drum after a transfer step is cleaned simultaneously with developing process by developing means and removed from the drum to be recovered and reused. By the cleaner-less method, a waste toner storage which stores waste toner scraped from above the drum using cleaning means is not necessary, which eliminates the necessity of replacing the filled waste toner storage. In this manner, a cartridge including only a drum and charging means in an integral form and a cartridge including only developing means in an integral form may be discretely provided, so that the user needs only replace the developing means. Such cartridges available on a functional basis may be even more compact and easily handled by the user. Multiple developing means each storing an amount of toner for a printable number of sheets desired by the user may be provided, so that the developing means may be used in combination for various uses.

As the charging means for charging the drum in the process cartridge, a contact-type charging device using a charging roller has been commercially available. A drum as a member to be charged is contacted by a conductive charging roller as a charging member, charging voltage is applied to the charging roller, and a drum surface is charged to a prescribed polarity or potential. The contact charging is carried out by discharge in a gap between the charging roller and the drum surface, which is advantageous over conventional corona charging means in that application voltage is lower and less ozone is generated.

The charging roller contacts the drum upper surface and therefore the surface is stained with toner, an external additive for improving the fluidity or charging performance of the toner, etc. Resistance is different between the stained part and the unstained part of the charging roller surface, and charging non-uniformity is generated on the drum, which causes a noticeable density difference to appear especially in a half-tone image depending on the resistance values. In particular, according to the cleaner-less method, there is no cleaning means which would normally be provided upstream of the charging member in the rotation direction of the drum, and therefore mainly transfer residual toner or fogging toner directly adheres to the charging member through the drum, which is more likely to cause charging non-uniformity.

As cleaning means for removing a stain from the charging roller, an approach of having a felt-type cleaning member abut against a charging roller has been proposed (see Japanese Patent Application Publication No. H02-272589), and another approach of contacting a cleaning member of resin foam (sponge member) to the charging roller in a rotatable manner has been proposed (see Japanese Patent Application Publication No. H08-062948). Using the cleaning means, the stain is removed from the surface of the charging roller physically or electrically by voltage application. These approaches need only a simple structure, and therefore means for removing stain by having a fixed type cleaning member abut against a charging roller is mainly provided.

Toner scraped from the surface of the charging roller is stored inside the fixed type cleaning member for cleaning the surface of the charging roller. As the amount of stored toner gradually increases and then exceeds a certain storage amount, the toner partly oozes out from the cleaning member and drops to stain the cartridge or the image forming apparatus in some cases. Therefore, cleaning operation for removing the stored toner from the cleaning member should be carried out. A method for carrying out the operation of cleaning the cleaning member for the charging member has been proposed (see Japanese Patent Application Publication No. 2011-133690).

SUMMARY OF THE INVENTION

However, during continuous printing, the cleaning member cannot be cleaned sufficiently, and the printing operation must be forcibly stopped for cleaning operation after a certain number of prints. Naturally, the cleaning operation lowers the productivity for the user since extra time for the operation in addition to printing is necessary. Therefore, there has been a demand for an image forming apparatus that can prevent the inside of the main body of the image forming apparatus from being stained, if the printable number of sheets before the start of the operation of cleaning by the cleaning member is increased.

In addition, when mounting a cartridge including a drum and charging unit in an integral form into the main body of the image forming apparatus, toner from the cleaning member for cleaning the charging roller drops to stain the main body because of an impact given by the mounting. This is because, in the cleaner-less method, nothing can completely seal around the drum and the charging roller like the cleaning unit or the waste toner storage as described above. The problem does not occur in an early stage of use and is in particular encountered after a certain number of prints when the user takes out the cartridge from the image forming apparatus to solve a trouble such as paper jamming in a state where toner is stored in the cleaning member for the charging roller.

With the foregoing in view, it is an object of the present invention to provide an image forming apparatus which is less prone to toner dropping from a cleaning member for a charging roller and can prevent the inside of the main body of the image forming apparatus from being stained if the toner drops.

In order to achieve the object, a cartridge according to the present invention includes an image bearing member which is rotatable and is provided in the cartridge, the cartridge being detachably provided to an apparatus main body of an image forming apparatus;

a charging roller which contacts and charges the image bearing member; and a cleaning member which cleans the charging roller, wherein the cleaning member has a brush portion in abutment against a surface of the charging roller, and in a section substantially orthogonal to a rotation axis of the image bearing member in a state where the cartridge is mounted to the apparatus main body, where a downstream end of an abutment region of the brush portion against the charging roller in a rotation direction of the charging roller is a first end, an upstream end of the abutment region in the rotation direction of the charging roller is a second end, and among tangents to the image bearing member, a tangent extending from a point of tangency in a rotation direction of the image bearing member and crossing the first end is a first tangent, the point of tangency of the first tangent on the image bearing member is vertically above a horizontal line passing through a center of the image bearing member, and the second end is vertically above the first end.

In order to achieve the object, an image forming apparatus according to the present invention includes the cartridge described above, wherein the image forming apparatus forms an image on a recording medium.

According to the present invention, more toner stains on the charging roller can be stored in the cleaning member for the charging roller and can be restrained from dropping into the main body of the image forming apparatus. An image forming apparatus can provided which can be prevented from being stained inside if toner drops into the image forming apparatus main body.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Example

Structure of Image Forming Apparatus

Figure 2:
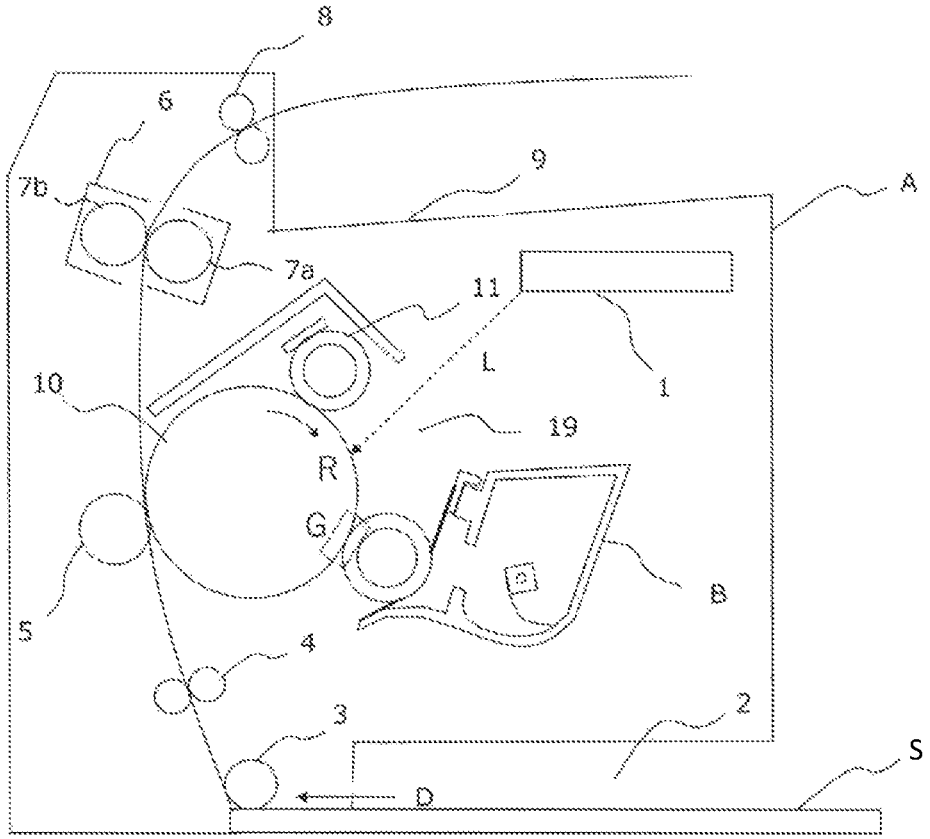
FIG. 2 is an image forming apparatus according to the first example.

In FIG. 2, an electrophotographic image forming apparatus (hereinafter as the "image forming apparatus") is a laser beam printer using electrophotography techniques which allows a cartridge B to be detachably provided to an image forming apparatus main body A (hereinafter as the "apparatus main body A"). When the cartridge B is mounted to the apparatus main body A, an exposure device 1 (laser scanner unit) is provided above the cartridge B. Here, the apparatus main body A refers to the image forming apparatus removed of the cartridge B.

A sheet tray 2 which stores a recording medium (hereinafter as the "sheet material S") on which an image is to be formed is provided under the cartridge B. In the apparatus main body A, a pickup roller 3, a transport roller pair 4, a transfer roller 5, a fixation device 6, a discharge roller pair 8, a discharge tray 9, and other elements are sequentially arranged in the transport direction D of the sheet material S. Note that the fixation device 6 includes a heating roller 7*a* and a pressure roller 7*b*.

Image Forming Process

Now, general aspects of the image forming process will be described with reference to FIGS. 2 and 3. A drum 10 having a size of ϕ26 is driven to rotate at a prescribed circumferential velocity (process speed of 100 mm/sec) in the direction of the arrow R in response to a printing start signal. The charging roller 11 contacts and uniformly charges the outer circumferential surface of the drum 10. Voltage applied at the time is a DC voltage of −1500 V and charges the upper surface of the drum 10 to −800 V. The exposure device 1 outputs a laser beam L corresponding to image information. The laser beam L is passed through an exposure window portion 19 at the upper surface of the cartridge B and irradiated on the outer circumferential surface of the drum 10 for scanning exposure. In this way, an electrostatic latent image corresponding to the image information is formed on the outer circumferential surface of the drum 10.

Figure 3:
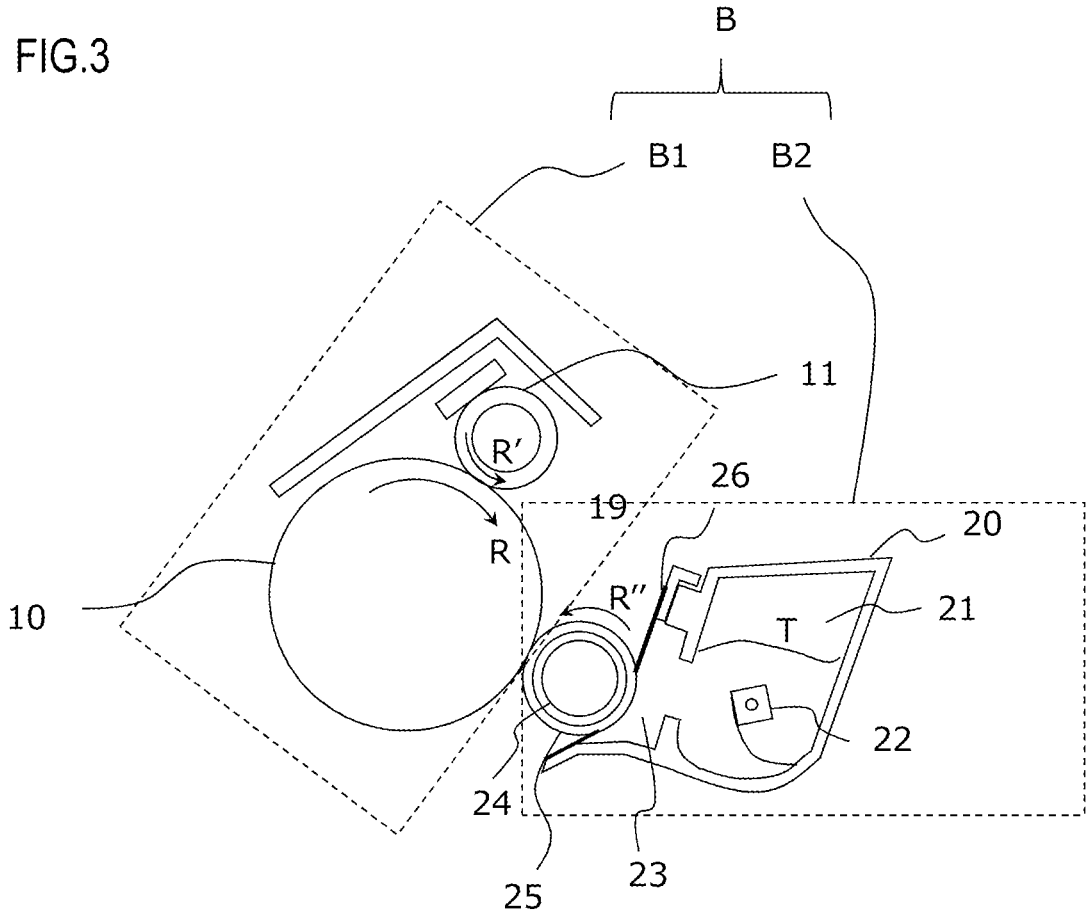
FIG. 3 shows a process cartridge according to the first example.

Meanwhile, as the section of the cartridge in FIG. 3 illustrates, toner T in a toner chamber 21 in a developing apparatus unit 20 as a developing apparatus is stirred by the rotation of a transport member 22, transported, and sent out into a toner supply chamber 23. The toner T includes one magnetic component and is born on a surface of a developing roller 25 which includes an element tube of aluminum having a size of ϕ12 and a coating of conductive rubber thereon as an elastic body having a thickness of 500 μm by the magnetic force of a magnet roller 24 (fixed magnet) as a magnetic body having a size of ϕ10. The developing roller 25 is driven to rotate through a driving gear from the main body at 140 mm/sec with a circumferential velocity ratio of 140% relative to the drum in the direction of the arrow R". While the toner T is charged by friction to negative polarity using a developing blade 26 and has its layer thickness restricted at the circumferential surface of the developing roller 25. A developing voltage (−300 V) is applied to the developing roller 25, so that the toner T is moved onto the drum 10 according to the electrostatic latent image and becomes visible as a toner image.

As shown in FIG. 2, simultaneously with the output timing for the laser beam L, the sheet material S stored under the apparatus main body A is fed by the pickup roller 3 and the transport roller pair 4 from the sheet tray 2. The sheet material S is supplied to a transfer position between the drum 10 and the transfer roller 5. In the transfer position, the toner image is sequentially transferred onto the sheet material S from the drum 10. The sheet material S having the toner image transferred thereon is removed from the drum 10 and transported to the fixation device 6. The sheet material S is passed through a nip portion between the heating roller 7*a* and the pressure roller 7*b* which constitute the fixation device 6. Pressurizing/heating fixation process is carried out at the nip portion, and the toner image is fixed on the sheet material S. The sheet material S having the toner image fixed thereon is transported to the discharge roller pair 8 and discharged onto the discharge tray 9.

Untransferred toner remaining on the drum 10 after the transfer includes toner charged to have positive polarity by discharge of transfer voltage (+1 kV) applied on the transfer roller 5 and fogging toner with positive polarity and is sent to the abutment position against the charging roller 11 as the drum 10 rotates. In the vicinity of the abutment position against the charging roller 11 the toner becomes toner T with negative polarity by discharge of charging voltage (−1500 V) applied by the charging roller 11 and is sent to a developing region G in which the developing roller 25 and the drum 10 are opposed to each other as the drum 10 rotates. In the developing region G, the toner T with negative polarity is recovered for reuse from the drum 10 to the developing roller 25 by the potential difference between the drum 10 and the developing roller 25.

Structure of Cartridge B

Now, an overall structure of the cartridge B will be described with reference to FIG. 3. The cartridge B includes a latent image apparatus unit B1 including the drum 10 and the charging roller 11 and forming a latent image, and a developing apparatus unit B2 including toner T, the developing roller 25, the developing blade 26, etc. and developing the latent image. These units are inserted and positioned in the apparatus main body A. The latent image apparatus unit B1 and the developing apparatus unit B2 are driven to rotate by driving means from the apparatus main body A. The drum 10 and the developing roller 25 can abut/part against/from each other by an abutting/parting mechanism (not shown) in the apparatus main body A. This is for the purpose of preventing the developing roller 25 and the drum 10 from being left unattended for a long period and deforming in abutment against each other.

Structure of Latent Image Apparatus Unit B1

Figure 4C:
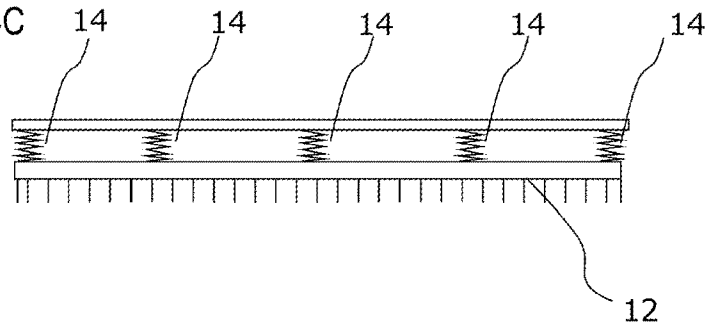
FIGS. 4A to 4D show a latent image apparatus unit according to the first example.
Figure 4D:
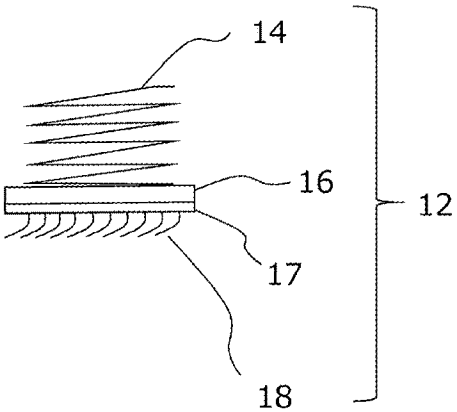
Figure 4A:
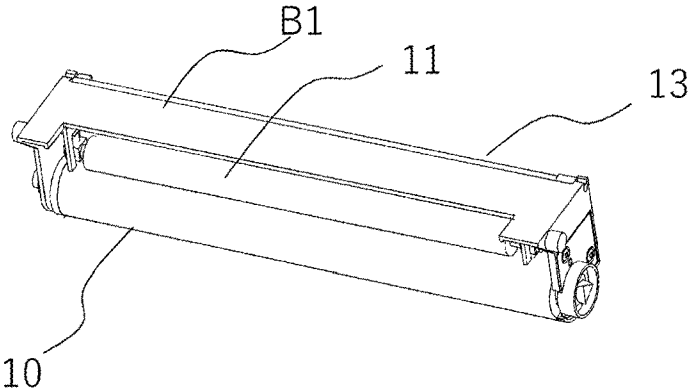
Figure 4B:
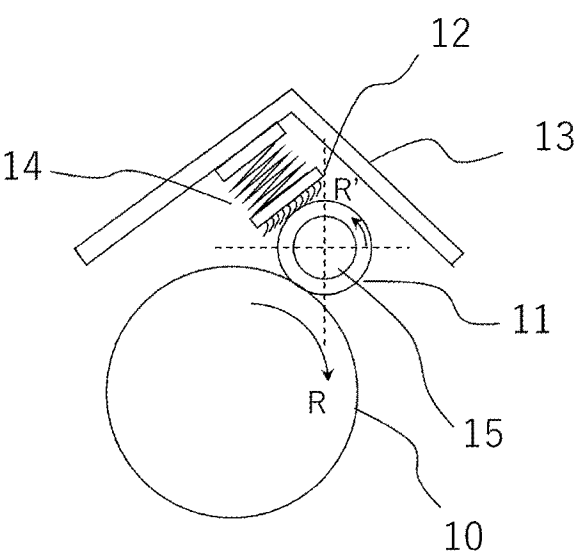

Now, a structure of the latent image apparatus unit B1 will be described with reference to FIGS. 4A to 4D. FIG. 4A is a perspective view of the latent image apparatus unit B1, and FIG. 4B is a sectional view of the latent image apparatus unit B1. As shown in FIGS. 4A and 4B, in the latent image apparatus unit B1, the drum 10 and the charging roller 11 are fixed and supported by a container frame body 13. The drum 10 rotates in the direction of the arrow R in the apparatus main body A, and the charging roller 11 in abutment against the drum 10 rotates in the direction of the arrow R' relative to the drum 10. At the time, the charging roller 11 is rotated with a circumferential velocity ratio of 110% relative to the drum 10 through a gear. This is for the purpose of providing the charging roller 11 with negative polarity by rubbing when the drum 10 passes the abutment position against the charging roller 11, so that cleaning simultaneous with development can be carried out more easily.

The cleaning member 12 is provided in abutment against the charging roller 11 in order to remove toner adhering to the upper surface of the charging roller 11. The cleaning member 12 is press-contacted to the charging roller 11 through a spring 14 provided at the container frame body 13 in the latent image apparatus unit B1. As shown in FIG. 4C, according to the present example, the cleaning member 12 is made to abut against the charging roller 11 by springs 14 in five points at equal intervals in the direction of the core metal 15 of the charging roller 11 so that the cleaning member 12 can uniformly abut against the charging roller 11, and the total abutment pressure is 300 gf. The abutment pressure is set from time to time to a level which allows both the effect of removing the stain on the charging roller 11 and the necessary containing amount of the toner T to be provided. More specifically, when the abutment pressure is low, the toner T on the surface of the charging roller 11 cannot be removed, while the toner T can be passed without being scraped, so that the time until the cleaning member 12 is filled with the toner T is prolonged. On the other hand, when the abutment pressure is high, the capability of removing the toner T from the surface of the charging roller 11 is increased, while the toner T is scraped excessively from the surface of the charging roller 11, so that the cleaning member 12 is soon filled with the toner T. More specifically, an optimum abutment pressure should be set so that the toner T on the surface of the charging roller 11 is not so actively scraped while no charging unevenness is generated.

Structure of Cleaning Member 12

Now, a structure of the cleaning member 12 according to the present example will be described with reference to FIG. 4D. The cleaning member 12 is a brush-shaped cleaning member 12 including a base 16 for receiving the spring 14 and a napped part 18 provided through a deposit portion 17 to serve as a brush portion. The deposit portion 17 has a thickness of 0.5 mm, the napped part 18 is formed into a brush shape having a length of 1.5 mm, and the material is conductive nylon. The resistance is 1 MΩ. The resistance refers to a resistance value measured 10 seconds after pressurizing using a pressing element with ϕ8 at 100 gf and applying a voltage of 50 V across the region between the pressing element and the deposit portion using HIOKI IR4051-11. The napped part 18 is napped and made to abut against the charging roller 11 in the forward direction with respect to the rotation direction of the charging roller 11 so that the toner T is scraped to a certain extent while charging non-uniformity is prevented as much as possible within the abutment part against the charging roller 11.

The cleaning member 12 and the charging roller 11 are normally kept at the same potential. This is because if the potential of the cleaning member 12 is on the negative polarity side with respect to the charging roller 11, the positive polarity toner enters the cleaning member 12, and the toner is collected excessively to the side of the cleaning member 12, which necessitates frequent cleaning operation. Conversely, if the potential of the cleaning member 12 is on the positive polarity side with respect to the charging roller 11, the effect of rubbing by the cleaning member 12 is reduced, and therefore a DC voltage of −1500 V is applied from a power supply (not shown) so that the cleaning member 12 and the charging roller 11 are normally kept at the same potential.

Abutment Position of Cleaning Member 12

Figure 5:
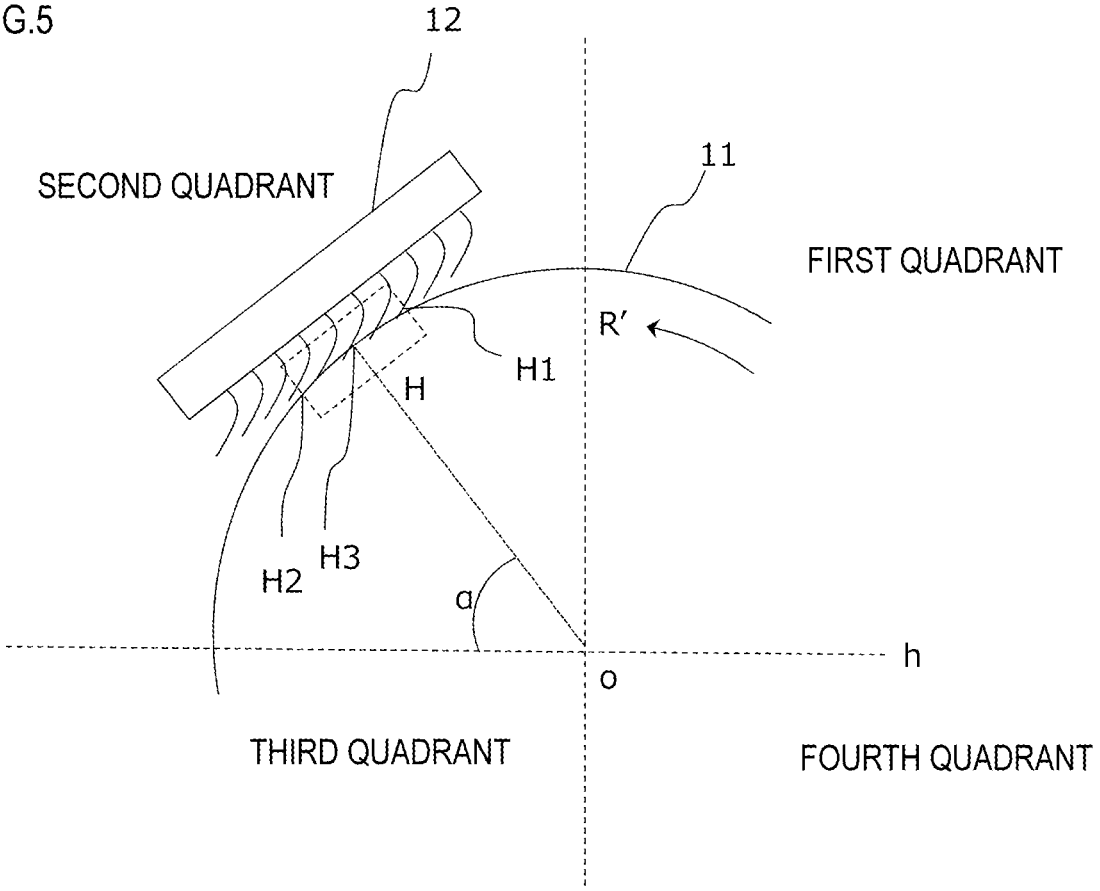
FIG. 5 is a view of an arrangement of the cleaning member according to the first example.

Now, the abutment position of the cleaning member 12 according to the present example will be described with reference to FIG. 5. The cleaning member 12 is disposed in abutment against the charging roller 11. An abutment region H having a certain width is formed at the abutment part at the time. An upstream end of the abutment region H in the rotation direction of the charging roller 11 is H1, a downstream end in the rotation direction of the charging roller 11 is H2, and a central position (the center of the abutment region) is H3 (hereinafter referred to as the upstream end H1, the downstream end H2, and central part H3). Among angles formed between a straight line as a virtual line passing through the center o of the charging roller 11 and the central part H3 and the horizontal line h in the mounted state in the apparatus main body A, the angle measured in the rotation direction of the charging roller 11 between the virtual line passing through the center o of the charging roller 11 and the central part H3 and the horizontal line h in the rotation direction of the charging roller 11 is a. The angle $\alpha$ at the time is referred to as the abutment angle of the cleaning member 12.

Behavior of Toner T

Figure 6D:
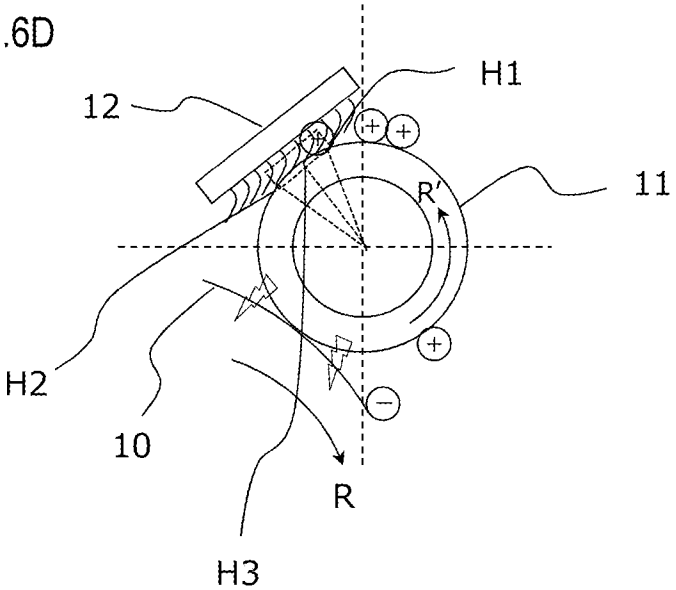
FIGS. 6A to 6D are views for illustrating toner behavior according to the first example.
Figure 6A:
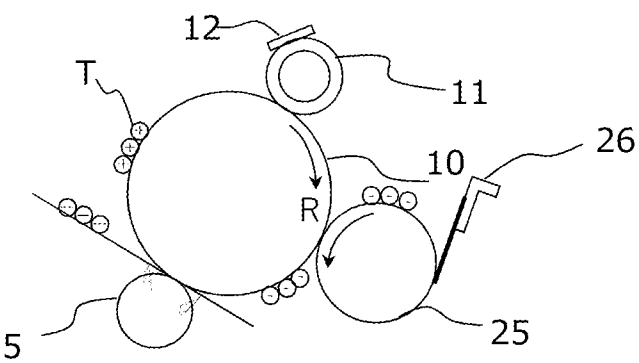
Figure 6B:
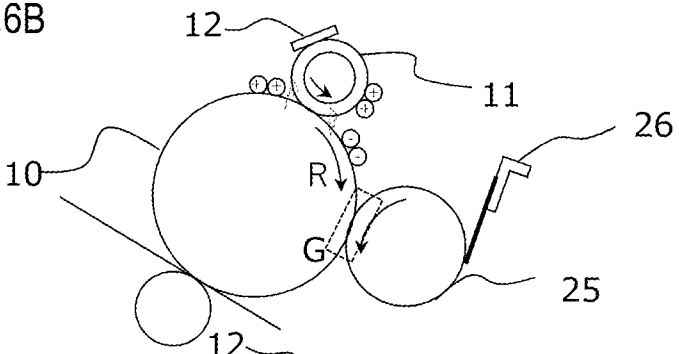
Figure 6C:
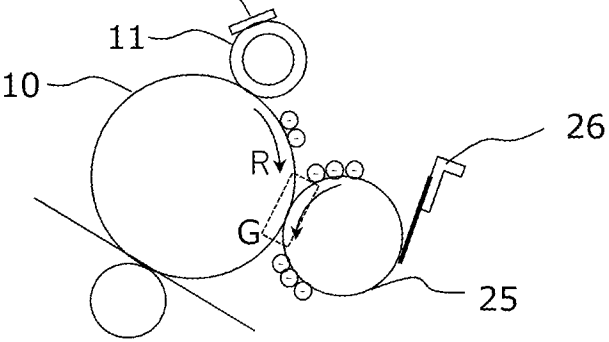

Now, the behavior of the toner T in the vicinity of the drum 10 will be described with reference to FIGS. 6A to 6D. As shown in FIG. 6A, the toner T charged by friction using the developing blade 26 on the developing roller 25 is charged to negative polarity and developed on the drum 10 from the developing roller 25 by the potential difference. The toner T developed on the drum 10 is transferred to the sheet material S as a material for transfer by a positive voltage applied to the transfer roller 5. At the time, untransferred tonner remaining on the drum 10 after the transfer roller 5 is passed is toner T having positive polarity. As shown in FIG. 6B, the toner T is sent to the abutment position against the charging roller 11 as the drum 10 rotates. The positive polarity toner T is then subject to discharging of a DC charging voltage of −1500 V in the vicinity of the abutment position against the charging roller 11 and charged to negative polarity. The negative polarity toner T passed through the abutment position against the charging roller 11 by the potential difference between the potential of the charging roller 11 (−1500 V) and the surface potential of the drum 10 (−800 V). The negative polarity toner T after passing the charging roller 11 is sent to the developing region G with the developing roller 25 as the drum 10 rotates. Then, the toner T sent to the developing region G is moved to the side of the developing roller 25 by the potential difference between the developing roller 25 (−300 V) and the drum 10 (−800 V) and finally recovered to the developing apparatus unit B2 as shown in FIG. 6C.

Meanwhile, the entire toner is not charged to the negative polarity by the discharging, and part of the toner maintains its positive polarity. The positive polarity toner as is moved to the charging roller 11 by the potential difference between the charging roller 11 (−1500 V) and the surface potential (−800 V) of the drum 10 as shown in FIG. 6D. The toner T adhering to the charging roller 11 is moved to the position in abutment against the cleaning member 12 as the charging roller 11 rotates. The toner T moved to the vicinity of the cleaning member 12 is collected by the cleaning member 12 or uncollected and passed. At the time, the toner T is most easily collected at the upstream end H1 where the toner T adhering to the charging roller 11 enters the cleaning member 12 first, and the amount of collected toner T is reduced toward the downstream end H2 in the abutment region H. The toner T uncollected and passed through the cleaning member 12 is rubbed by the brush of the cleaning member 12 and charged to negative polarity and move again into the abutment region between the charging roller 11 and the drum 10. The toner T is further charged to negative polarity by the charging voltage in the vicinity of the abutment region between the charging roller 11 and the drum 10. The negative polarity toner T is moved from the charging roller 11 onto the drum 10 by the potential difference at the abutment part between the charging roller 11 and the drum 10 and again moved to the developing roller 25 as shown in FIGS. 6B and 6C. The toner still charged to positive polarity is again moved to the cleaning member 12 as the charging roller rotates. In this manner, the toner T on the charging roller 11 is gradually collected by the cleaning member 12 and accumulated.

Cleaning Operation by Cleaning Member 12

Figure 7A:
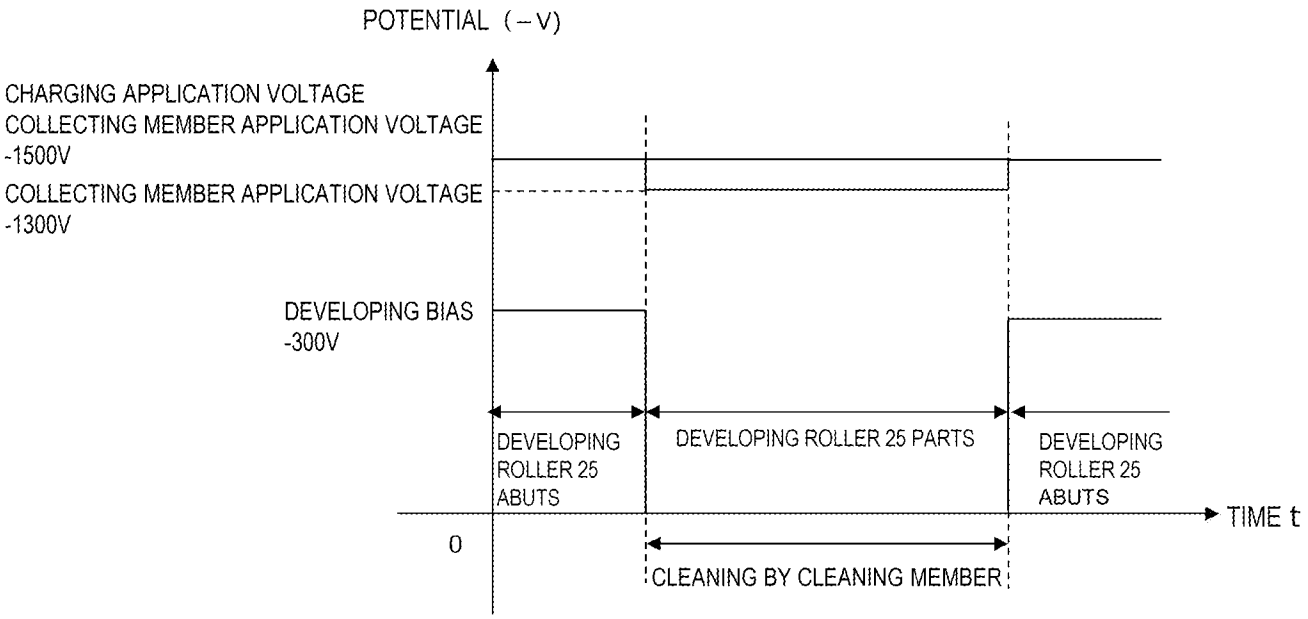
FIGS. 7A and 7B show cleaning operation according to the first example.
Figure 7B:
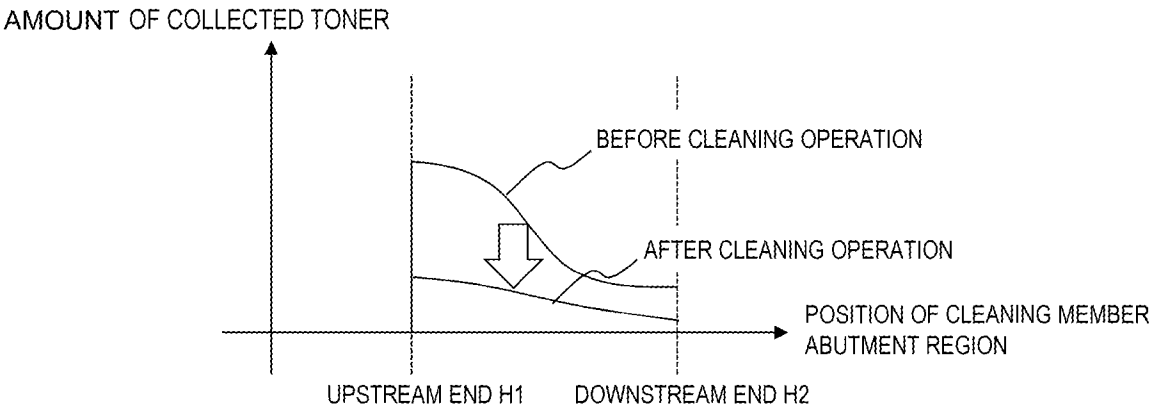

Now, cleaning operation for discharging the toner T collected by the cleaning member 12 will be described with reference to FIGS. 7A and 7B. FIG. 7A is a schematic view for illustrating the operation. During the cleaning operation by the cleaning member 12, the developing roller 25 and the drum 10 are parted so that the positive polarity fogging toner T is prevented from moving onto the drum 10. When the positive polarity fogging toner T stops moving onto the drum 10, the amount of the positive polarity toner T moving onto the charging roller 11 or entering into the cleaning member 12 is reduced. As the amount of the positive polarity toner T entering into the cleaning member 12 is reduced, the amount of toner stored in the cleaning member 12 is relatively larger than the amount of toner on the charging roller 11. The amount of collected toner is more than the amount of passing toner, the toner T moves from the cleaning member 12 onto the charging roller 11 so that a balance is re-established between the collected amount and the passing amount. This is because physical adhering force between the toner and the charging roller 11 is stronger than physical adhering force among toner particles, and once the surface of the charging roller 11 becomes clean, the toner more easily physically adheres to the charging roller 11.

During the cleaning operation, the cleaning member 12 is applied with a DC voltage of −1300 V so as to have positive polarity with respect to the charging roller 11. At the time, the toner T is moved from the cleaning member 12 to the charging roller 11 by the potential difference between the cleaning member 12 and the charging roller 11. The effect of rubbing as the toner passes the cleaning member 12 is reduced, but the charging voltage applied to the charging roller 11 generates discharge, which causes the toner T to have negative polarity and move onto the drum 10. The negative polarity toner moved onto the drum 10 is recovered into the developing apparatus unit B2 in the developing region G as the developing roller 25 is again made to abut against the drum 10. FIG. 7B schematically shows how the toner T collected by the cleaning member 12 changes by the cleaning operation. The toner T collected by the cleaning member 12 cannot be removed completely after the cleaning operation but can be reduced to some extent as compared to the amount before the cleaning.

As described above, periodic cleaning operation for example after printing operation or printing a prescribed number of sheets allows the collected toner in the cleaning member 12 to be reduced, so that good printing can be continued during normal operation.

Figures 8A, 8B, 8C:
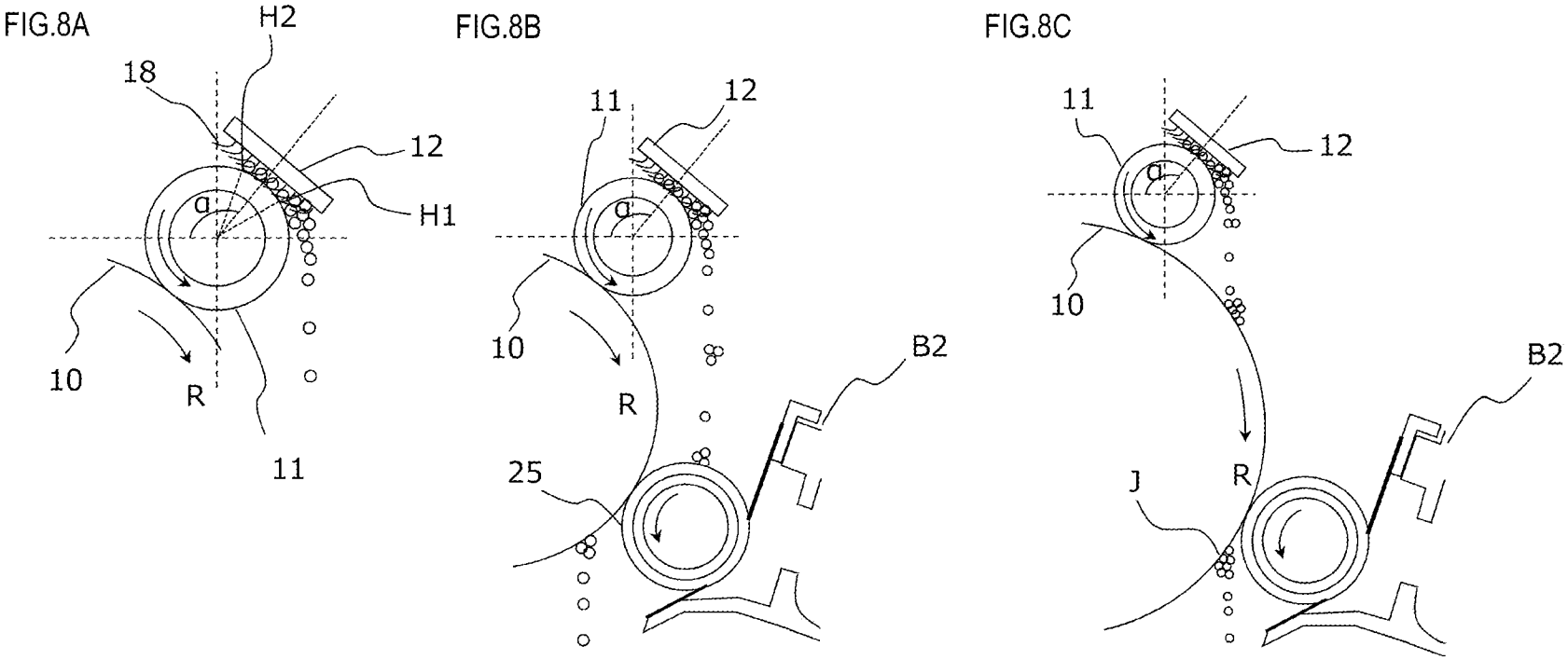
FIGS. 8A to 8C are views for illustrating toner behavior according to the first example.

Structure of Abutment Part of Cleaning Member 12 at Upstream End H1 According to Present Example Now, how the toner T drops from the cleaning member 12 will be described with reference to FIGS. 8A to 8C. The toner is collected by the cleaning member 12 mainly at the upstream end H1. The toner T is more likely to drop as the toner collected by the cleaning member 12 particularly at the upstream end H1 increases and toner particles aggregate. Therefore, as shown in FIG. 8A, the toner is more likely to drop when the upstream end H1 of the cleaning member 12 is below the downstream end H2. The dropped toner may directly fall on the developing apparatus unit B2 and stain the developing apparatus unit B2 or the toner dropped on the developing roller 25 moves onto the drum 10 again and further fall on the sheet material S or inside the apparatus main body A and stains them as shown in FIG. 8B. Also as shown in FIG. 8C, the positive polarity toner dropped on the drum 10 may pass the developing region as the drum 10 rotates and eventually depart from the drum 10 by gravity to fall on the sheet material S or inside the apparatus main body A. As shown in FIGS. 8B and 8C, the toner departs from the drum 10 by gravity because the toner dropped from the cleaning member 12 is in the form of aggregate J, the behavior of which is different from normal toner behavior, and cannot be retained on the surface of the drum 10.

Figure 9A:
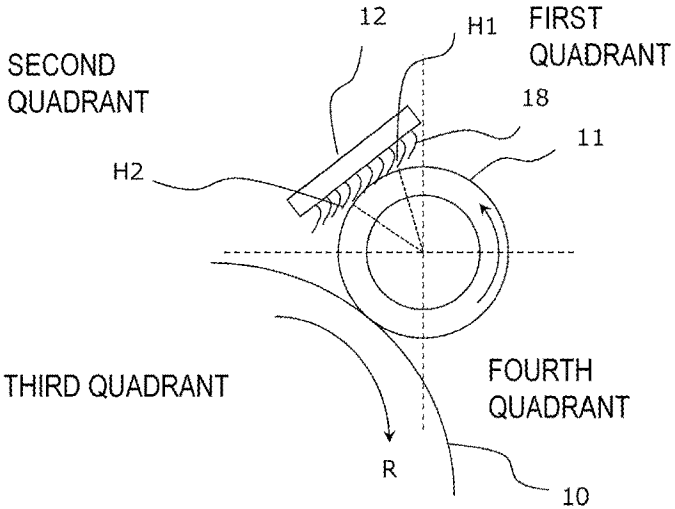
FIGS. 9A to 9C are views of an arrangement of the cleaning member according to the first example.
Figure 9B:
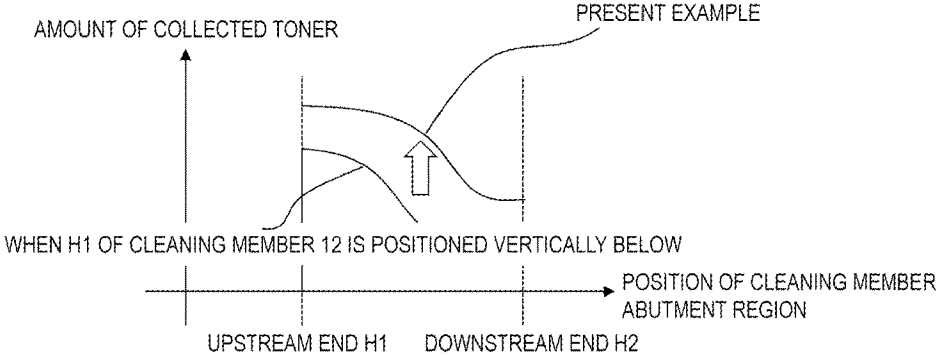

Therefore, the charging roller 11, the cleaning member 12, and the drum 10 are arranged as follows. As shown in FIG. 9A, in a section perpendicular to the rotation axis of the charging roller 11, it is assumed that the rotation axis is the origin, the vertical direction is the Y-axis direction, and the direction (horizontal direction) orthogonal to the vertical direction is the X-axis direction. In this way, the abutment region H of the brush part as the napped part of the cleaning member 12 against the charging roller 11 must be arranged in the second quadrant. In particular, the upstream end H1 where the toner T from the cleaning member 12 is more easily stored needs only be vertically above the downstream end H2. With reference back to FIG. 1, when the upstream end H1 is positioned vertically above the downstream end H2, the abutment angle $\alpha$ of the cleaning member 12 described above is limited in the range expressed by $0°<\alpha<90°$. The upstream end H1 is positioned below a topmost part of the charging roller 11. Furthermore, the contact part between the charging roller 11 and the drum 10 is positioned vertically below the horizontal line passing through the center of the rotation axis of the charging roller 11 and on the opposite side to the abutment region H with respect to the vertical line passing through the center of the rotation axis of the charging roller 11 therebetween. When the upstream end H1 is vertically above the downstream end H2, the toner T is more easily collected by the napped part 18 of the cleaning member 12, and the toner exceeding a collectable amount is less likely to drop into the apparatus main body A. FIG. 9B is a schematic view of the collected and stored amount of toner in the cleaning member 12, which indicates that as the upstream end H1 is vertically above the downstream end H2, the total amount of collected toner increases. Therefore, the number of printable sheets until the start of periodic cleaning operation by the cleaning member 12 can be increased, which can lead to improved productivity for the user.

Figure 9C:
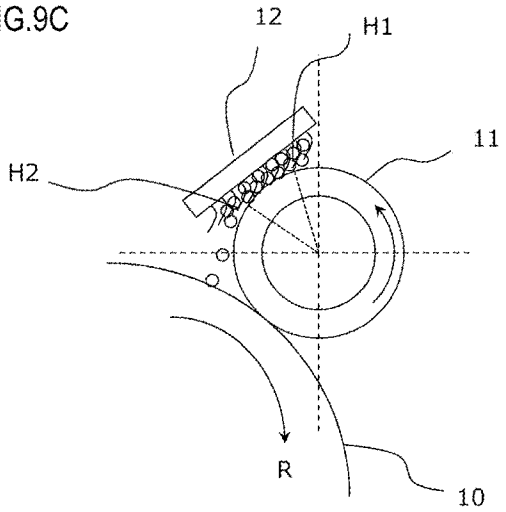
Figure 10B:
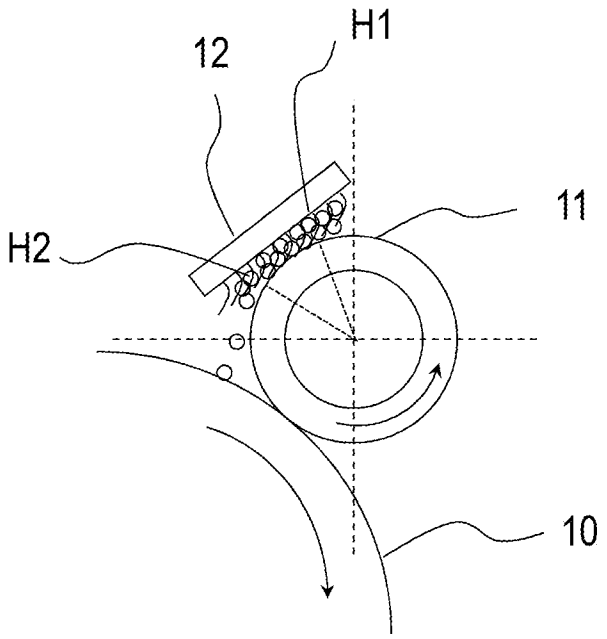
FIGS. 10A and 10B are views for illustrating verification experiments according to the first example.
Figure 10A:
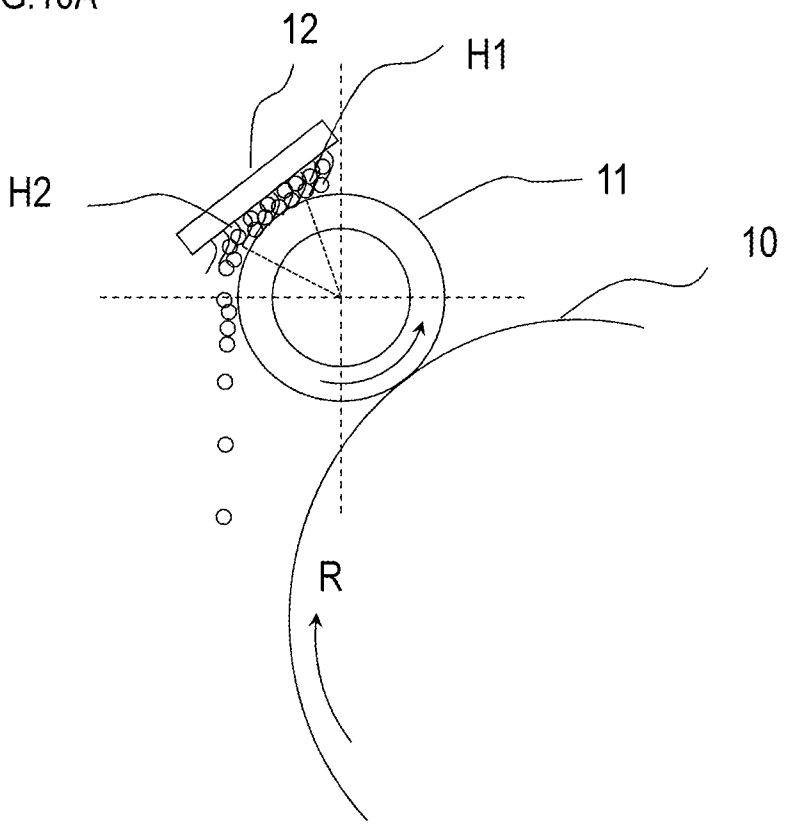

Structure of Abutment Part of Cleaning Member 12 at Downstream End H2 According to Present Example The upstream end H1 of the cleaning member 12 is set vertically above the downstream end H2, so that the toner retention amount until the toner T drops from the cleaning member 12 increases, while the toner T may drop from the downstream end H2 as shown in FIG. 9C. This is because as the upstream end H1 is set vertically above the downstream end H2, the downstream end H2 is positioned on the lower side in the vertical direction, and as the total amount of toner stored in the cleaning member 12 increases, the amount of toner stored on the downstream side also increases. However, as shown in FIG. 10A, unless the toner from the downstream end H2 of the cleaning member 12 drops in a location on the drum 10, the inside of the apparatus main body A is directly stained, while the toner dropped on the drum 10 may be recovered as shown in FIG. 10B. This is because the toner T dropped on the drum 10 from the downstream end H2 as shown in FIG. 10B is sent to the vicinity of the abutment position of the charging roller 11 as the drum 10 rotates, and the behavior of the toner T described above is repeated.

Figure 1:
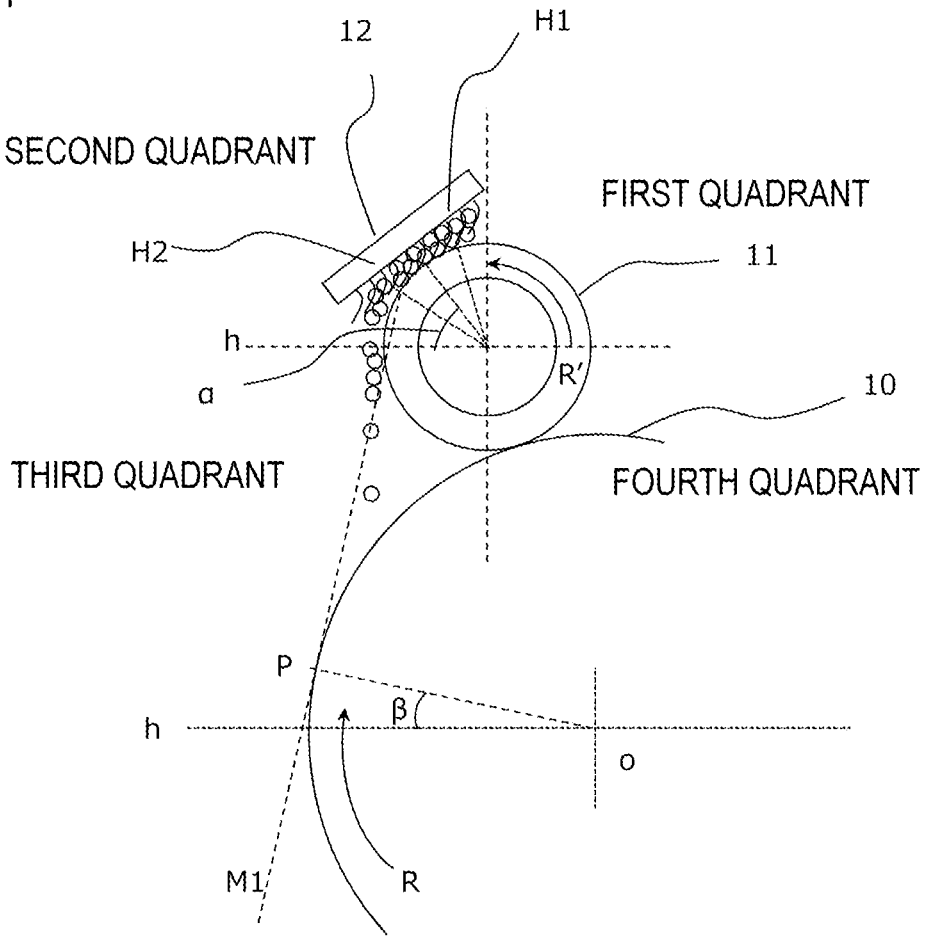
FIG. 1 is a view of an arrangement of a cleaning member according to a first example.

The toner T drops on the drum 10 from the downstream end H2 under the following condition. As shown in FIG. 1, in the section substantially orthogonal to the rotation axis of the charging roller 11, a line passing through the downstream end H2 of the cleaning member 12 and in contact with the drum 10 is a first tangent M1. A contact point for the tangent M1 to the drum 10 is a point of tangency P, the point of tangency P must be above the horizontal line h passing through the center o of the drum 10. The horizontal line h in this case is the horizontal line as the drum 10 is inserted in the apparatus main body A, and among angles formed between the horizontal line h and the segment OP, the angle measured in the rotation direction of the drum 10 between the horizontal line h and the segment OP is $\beta$. The angle $\beta$ is limited within the range expressed by $0°<\alpha<90°$ from the positional relation among the electrostatic member, the charging roller, the photosensitive drum, etc. Under the condition, the toner T dropped from the downstream end H2 of the cleaning member 12 does not stain the inside of the apparatus main body A.

As described above, the toner may be prevented from dropping from the upstream end H1 of the cleaning member 12, while the inside of the apparatus main body A can be prevented from being stained by the toner from the downstream end H2.

Verification Experiments

Figure 11A:
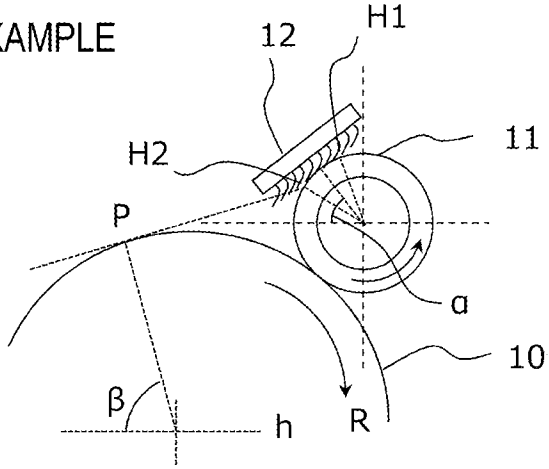
FIGS. 11A to 11D are views for illustrating an arrangement of the cleaning member according to the first example.
Figure 11B:
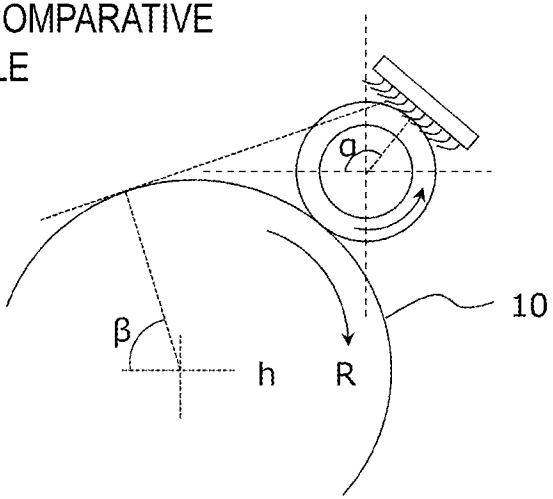
Figure 11C:
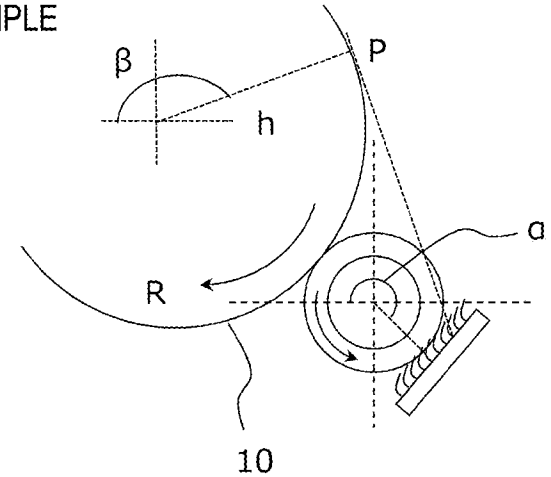
Figure 11D:
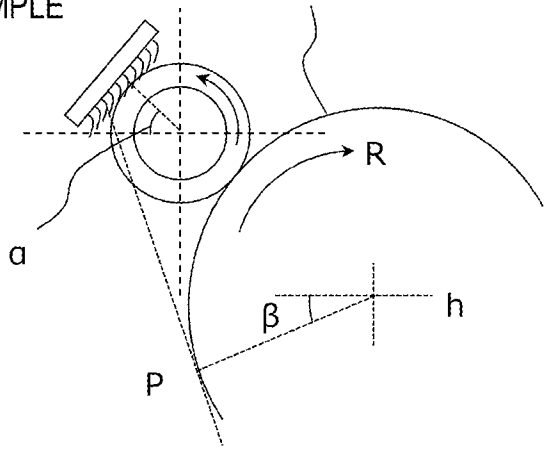

The degree of collection of toner T depending on the arrangement of the cleaning member 12 with respect to the charging roller 11 was examined. FIG. 11A shows the structure of the present example, and FIG. 11B shows a first comparative example in which the upstream end H1 is vertically below the downstream end H2. FIG. 11C shows a second comparative example in which the charging roller 11 is positioned under the drum 10. In a third comparative example, the upstream end H1 is vertically above the downstream end H2, while the point of tangency P of the tangent M1 on the drum 10 passing through the downstream end H2 is below the horizontal line h was verified. Table 1 shows the abutment angle $\alpha$ between the cleaning member 12 and the charging roller 11 and the angle $\beta$ formed between the segment through the center o of the drum 10 and the point of tangency P and the horizontal line h in each of the examples. The temperature in an evaluation environment was 20° C., the humidity was 50%, and a traverse line was printed in a printing mode with a print percentage of 4%.

The number of prints allowed until cleaning operation by the cleaning member 12 as an evaluation item refers to the number of sheets printed until toner can no longer be collected by the cleaning member 12 and drops into the apparatus main body A.

As a toner dropped state, whether the toner dropped in the apparatus main body A after the same number of prints was also evaluated. The number of prints at the time was 100. In the table, O represents the case in which no toner dropped in the apparatus main body A, Δ represents the case in which a small amount of toner dropped in the apparatus main body A, and X represents the case in which a large amount of toner dropped in the apparatus main body A. Table 1 gives the result of verification experiments.

TABLE 1

| | α | β | Number of prints until cleaning operation | Toner dropped state |
|---|---|---|---|---|
| First example | 45° | 30° | 110 | ○ |
| First comparative example | 135° | 70° | 60 | X |
| Second comparative example | 225° | 150° | 55 | X |
| Third comparative example | 45° | −20° | 86 | Δ |

In the first and second comparative examples, the upstream end H1 where toner collected by the cleaning member 12 aggregated as described above was vertically below the downstream end H2, and the toner T was not retained by the cleaning member 12 and more easily dropped. Also in the first comparative example, the angle α was outside the angle range of $0°<\alpha<90°$. In the second comparative example, the angles α and β were both greatly outside the ranges according to the first example expressed by $0°<\alpha<90°$ and $0°<\beta<90°$. Therefore, the number of prints allowed until cleaning operation by the cleaning member 12 in the first and second comparative examples was small. In a third comparative example, since the upstream end H1 was vertically above the downstream end H2, the angle α was within the same range as the first example unlike the first and second comparative examples. However, although the amount of dropped toner was small, toner dropped from the downstream end H2. This is because the point of tangency P of the tangent M1 on the drum through the downstream end H2 was below the horizontal line h of the drum 10, and the toner more easily dropped from the downstream end H2. Therefore, the number of prints allowed until cleaning operation by the cleaning member 12 was smaller than that in the first example.

From the result, the configuration according to the first example allows the amount of toner dropped from the cleaning member 12 to be reduced, so that the number of prints allowed until cleaning operation by the cleaning member 12 is carried out can be increased.

Second Example

The description of the first example concerns toner dropped from the cleaning member 12 during normal printing. In the following description of a second example, another case in which toner drops from the cleaning member 12 will be described with reference to the case in which an impact is generated by mounting the cartridge B.

As described in connection with the first example, printing is forcibly stopped to carry out cleaning operation by the cleaning member 12 during continuous printing. However, in a particular case such as paper jamming, the user may take the cartridge out in order to recover the situation. In particular, when the cartridge is taken out before cleaning operation by the cleaning member 12 is forcibly carried out during continuous printing, toner may be accumulated in the cleaning member 12. When the cartridge is once again mounted after the recovery, an impact generated by mounting the cartridge may cause toner to drop from the cleaning member 12 and stain the inside of the apparatus main body A. In the second example, an image forming apparatus that can prevent the inside of the apparatus main body A from being stained in such a situation can be provided. The apparatus main body A and the cartridge B in the present example are basically the same as those in the first example, and only features unique to the second example will be described.

Impact Generation Mechanism

Figure 12A:
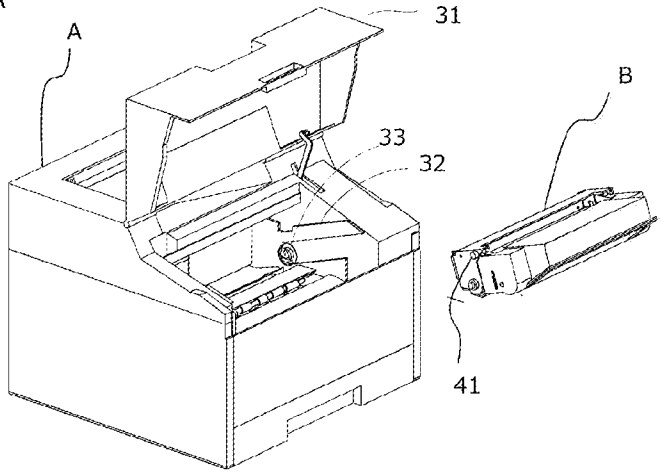
FIGS. 12A to 12E are views of how a cartridge is inserted according to a second example.

Here, the reason for the impact generation during mounting will be described. FIG. 12A is a perspective view of the apparatus main body A and the cartridge B, in which the apparatus main body has its opening/closing door 31 opened for detaching/mounting of the cartridge B. The opening/closing door 31 is rotatably attached to the apparatus main body A. When the opening/closing door 31 is opened, guide rails 32 are provided, and the cartridge B is mounted into the apparatus main body A along the guide rails 32. A driving shaft 33 driven by a motor (not shown) in the apparatus main body A engages with a driving force receiving portion provided at the cartridge B. In this way, the drum 10 connected with the driving force receiving portion rotates upon receiving driving force from the apparatus main body A.

Figure 12B:
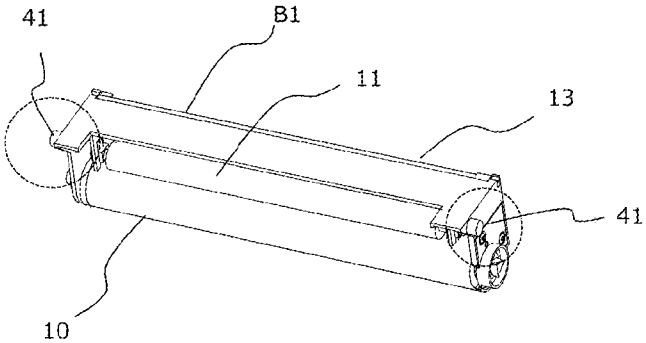
Figure 12C:
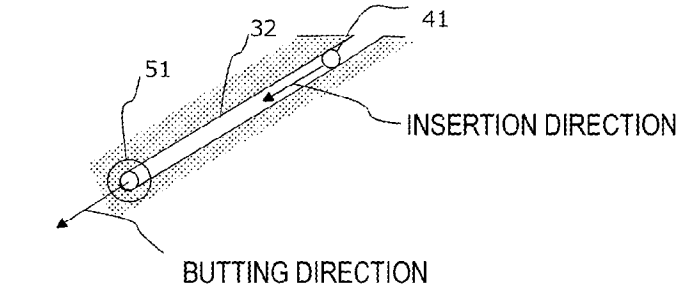

Projections 41 for guiding the cartridge to move along the guide rails 32 are provided at side surfaces of the latent image apparatus unit B1 as shown in FIG. 12B, and the cartridge B can be inserted into the apparatus main body A in the direction indicated by the arrow in FIG. 12C as the projections draw a fixed track regardless of the user's operation. Then, the cartridge B inserted in the fixed direction through the guide rails 32 must be positioned in a fixed position so that the driving portion is connected with the inside of the apparatus main body A. The cartridge B is inserted into a positioning portion 51 provided in the apparatus main body, so that the cartridge B can finally be positioned in the apparatus main body A, connected with the driving shaft 33, and driven. At the time, as the user may have the projections 41 of the cartridge B abut against the positioning portion 51 in the apparatus main body A to complete the positioning of the cartridge B, this abutting may stop the movement of the cartridge B, and an impact is generated at the time of abutting at the cartridge B. The impact may cause toner from the cleaning member 12 to drop and stain the inside of the apparatus main body A as described above.

Figure 12D:
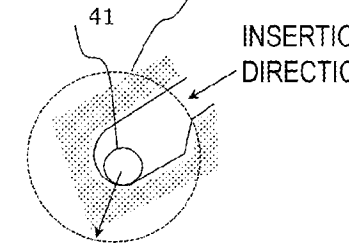
Figure 12E:
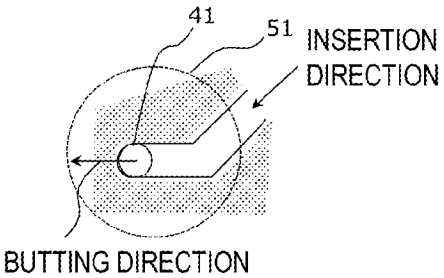

Here, a cartridge insertion direction W in the present example will be defined. In FIG. 12C, the direction in which the cartridge B is inserted in the apparatus main body A for the first time and the direction in which the projections 41 abut against the positioning portion 51 are the same. However, as shown in FIGS. 12D and 12E, depending on the shape, the direction in which the cartridge B starts to be inserted into the apparatus main body A and the direction in which the projections eventually abut against the positioning portion 51 are not always the same. As for the impact by butting, the direction of butting against the position positioned to allow driving with the driving shaft 33 is related to an actual impact, and therefore the direction of butting which eventually causes the impact at the positioning portion 51 will be referred to as the cartridge insertion direction W in the present example.

Relation between Cartridge Insertion Direction W and Toner Flying Direction

The cartridge B butts against the positioning portion 51 during insertion, so that toner is spattered in two directions from the cleaning member 12. One of the directions coincides with the cartridge insertion direction W on the principle of inertia. As for the other direction, the toner is pressed by the cleaning member 12 in the direction in which the cleaning member 12 receives force as the cartridge butts against the positioning portion 51 and the toner is more likely to fly in the opposite direction to the cartridge insertion direction W. More specifically, the toner flies in the direction along the cartridge insertion direction W and the opposite direction thereto. Therefore, the positional relation between the cartridge insertion direction W and the cleaning member 12 will be described.

Upstream End H1 of Cleaning Member 12 in Present Example

Figure 13A:
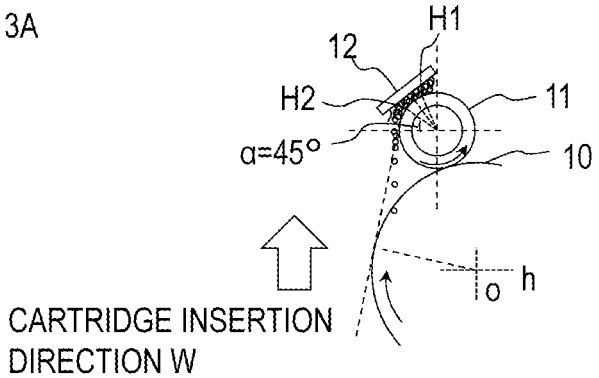
FIGS. 13A to 13E show a positional relation between an insertion direction and a cleaning member according to the second example.

Since the upstream end H1 of the cleaning member 12 is vertically above the downstream end H2 similarly to the first example, the toner does not drop in the apparatus main body A if an impact is generated in any direction during insertion. With reference to FIGS. 13A to 13E, different cartridge insertion directions W will be described. Here, only the upstream end H1 will be described sequentially. In FIG. 13A, the cartridge insertion direction W is upward as indicated by the large arrow. In this case, the toner T flies in the vertical direction, in other words, moves only onto the cleaning member 12 and the charging roller 11 and does not stain the inside of apparatus main body A.

Figure 13B:
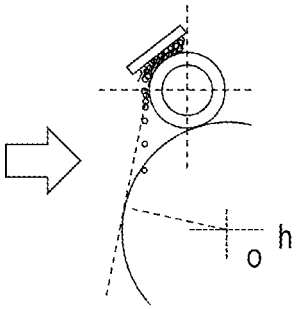

In FIG. 13B, the cartridge insertion direction W is rightward. In this case, the toner in the cleaning member 12 flies onto the charging roller 11. However, when the toner thus flies onto the charging roller 11, the charging roller 11 rotates to send the toner back to the cleaning member 12, and therefore the toner does not stain the inside of the apparatus main body A.

Figure 13C:
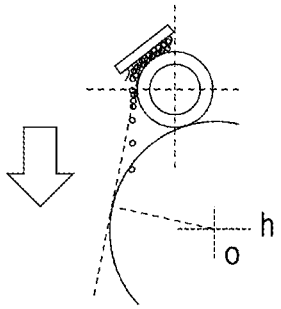
Figure 13D:
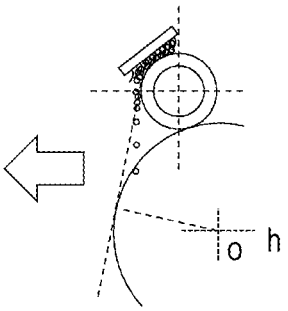

In FIG. 13C, the cartridge insertion direction W is downward. In this case, the toner flies only toward the charging roller 11 and the cleaning member 12 and does not stain the inside of the apparatus main body A. Finally, in FIG. 13D, the toner flies onto the charging roller 11 similarly to FIG. 13B, but the charging roller 11 rotates to send the toner back into the cleaning member 12, and therefore the toner does not stain the inside of the apparatus main body A. As described above, in relation to the upstream end H1 of the cleaning member 12, the toner does not stain the inside of the apparatus main body A regardless of the cartridge insertion directions W.

Downstream End H2 of Cleaning Member 12 in Present Example

Figure 13E:
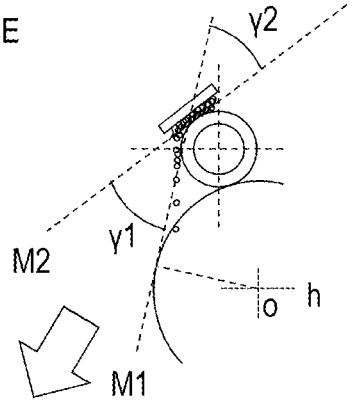

Now, different cartridge insertion directions W in connection with the downstream end H2 of the cleaning member 12 will be described. In consideration of various cartridge insertion directions W, toner may spatter from the downstream end H2 and stain the inside of the apparatus main body A when the cartridge is inserted in a certain cartridge insertion direction W. This may happen when the cartridge is inserted in the following insertion direction. As shown in FIG. 13E, the second tangent M2 passes through the contact point between the surface of the charging roller 11 and the central part H3 of the abutment region H between the charging roller 11 and the cleaning member 12, and the first tangent M1 to the drum 10 passes through the downstream end H2 of the cleaning member 12. Then, when the insertion direction is a direction (γ1 or γ2 in FIG. 13E) between the tangents M1 and M2 around the crossing point of these two tangents, the toner may drop and stain the inside of the apparatus main body A.

This is because when the cartridge insertion direction W is in any of the directions, the toner dropped from the downstream end H2 directly falls into the apparatus main body A instead of falling onto the drum 10. Meanwhile, when the cartridge insertion direction W is in a direction not between the two tangents, the toner does not fall into and stain the apparatus main body A.

More specifically, as the tangents M1 and M2 cross each other, the region including the charging roller 11, the drum 10, etc. is divided into four. Among the four regions, the region including the charging roller 11 is a first region, and the regions other than the first region are referred to as second, third, and fourth regions in the rotation direction of the charging roller 11 or in the anticlockwise direction in FIGS. 13A to 13E. Note that in the present example, the entire charging roller 11 is stored in the first region, but a part of the charging roller 11 may exist in any of the other regions, and still the advantageous effect of the invention can be provided. When the cartridge insertion direction W is a direction toward the first or third region among these four regions with the crossing point of the first and second tangents M1 and M2 as the origin, the toner does not drop. More strictly speaking, the toner does not drop when the charging device which includes the cleaning member 12 and the charging roller 11 moves so that the crossing point of the first and second tangents M1 and M2 moves in a direction toward the first or third region.

Verification Experiments

Figure 14A:
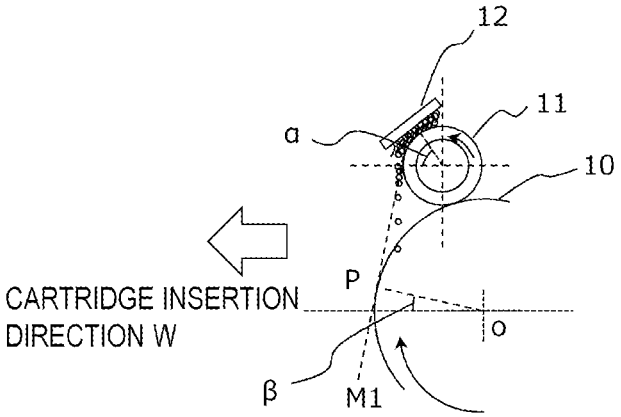
FIGS. 14A to 14C are views showing a structure of comparative examples compared to the second example.
Figure 14B:
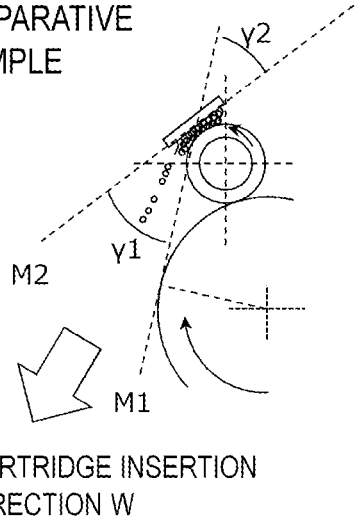
Figure 14C:
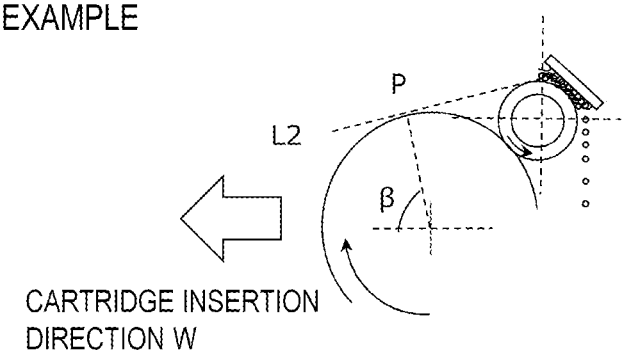

Experiments were carried out to examine whether the structure according to the second example does not allow toner to stain the inside of the apparatus main body A. As an examination method, while changing the cartridge insertion direction W and the abutment arrangement of the cleaning member 12, it was examined whether the toner stained the inside of the apparatus main body A. More specifically, as shown in FIG. 14A, in the second example, the cartridge insertion direction W was leftward and the abutment angle α of the cleaning member 12 was 45°, the angle β between the point of tangency P and the horizontal line h through the center of the drum 10 was 30°. More specifically, similarly to the first example, the angles α and β were within the ranges expressed by $0° < \alpha < 90°$ and $0° < \beta < 90°$, respectively.

In the first comparative example, the cartridge insertion direction W was in the direction toward the region γ1 between M1 and M2 as described above, the abutment angle α of the cleaning member 12 was 45°, the angle β between the point of tangency P and the horizontal line h through the center of the drum 10 was 30°. The first comparative example is identical to the second example except for the cartridge insertion direction W. In the second comparative example, the cartridge insertion direction W was leftward, the abutment angle α of the cleaning member 12 was 135°, and the angle β between the point of tangency P and the horizontal line h through the center of the drum 10 was 70°. In the second comparative example, the cartridge insertion direction W was the same direction as that in the second example while the position of the cleaning member 12 was different for comparison.

In the verification experiments, the amount of toner collected by the cleaning member 12 was kept constant, and the velocity during cartridge insertion was constant. More specifically, before the start of cleaning operation by the cleaning member 12, the driving was forcibly stopped once, the number of prints for which the amount of toner collected by the cleaning member 12 reached a fixed amount was checked, and the driving was forcibly stopped. Then, the cartridge B was taken out from the main body and inserted back into the apparatus main body A. At the time, the cartridge B was taken out again and it was visually checked whether the toner T had dropped in the apparatus main body A. The total amount of toner collected by the cleaning member 12 was 10 mg and the insertion velocity in insertion was 0.5 m/sec.

The result of verification is given in Table 2. The evaluation was carried out in an environment in which the temperature was 20° C. and the humidity was 50%, O represents the case in which no toner dropped in the apparatus main body A, Δ represents the case in which a small amount of toner dropped in the apparatus main body A, and X represents the case in which a large amount of toner dropped in the apparatus main body A.

TABLE 2

| | α | β | Toner dropped state during mounting |
|---|---|---|---|
| Second example | 45° | 30° | ○ |
| First comparative example | 45° | 30° | X |
| Second comparative example | 135° | 70° | X |

According to the second example, the toner did not drop either from the upstream end H1 and the downstream end H2. In the first comparative example, the angles α and β are the same as those in the second example, the cartridge insertion direction is between the tangent M1 to the drum 10 passing through the downstream end H2 and the tangent M2 through the contact point between the charging roller 11 and the central part H3 in the abutment region between the charging roller 11 and the cleaning member 12. Therefore, the toner dropped from the downstream end H2 and stained the inside of the apparatus main body A. In the second comparative example, the angle α was greater than the range in the second example, the upstream end H1 of the cleaning member 12 is directed downward in the vertical direction, and therefore a large amount of toner dropped from the upstream end H1 and stained the inside of the apparatus main body A more than in the first comparative example.

As in the foregoing, the tangent M2 to the charging roller 11 passes through the contact point between the central part H3 of the abutment region between the charging roller 11 and the cleaning member 12, and the tangent M1 to the drum 10 passes through the downstream end H2 of the cleaning member 12. In this case, when the cartridge insertion direction W is present in a direction not between M1 and M2, the toner does not stain the inside of the apparatus main body A, and high quality images can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-152667, filed on Aug. 7, 2017, which is hereby incorporated by reference herein in its entirety.

What is claimed is:

1. A cartridge, comprising:

a photosensitive drum which is rotatable and is provided in the cartridge, the cartridge being detachably provided to an apparatus main body of an image forming apparatus;

a charging roller which contacts and charges the photosensitive drum; and a cleaning member which cleans the charging roller, wherein the cleaning member has a brush portion, at least a part of the brush portion contacting a surface of the charging roller, wherein, in a section orthogonal to a rotation axis of the photosensitive drum in a state where the cartridge is mounted to the apparatus main body, a first end denotes a downstream end of an abutment region of the brush portion in a rotation direction of the charging roller, a second end denotes an upstream end of the abutment region in the rotation direction of the charging roller, a first tangent denotes a tangent in which a direction from a point of tangency of the tangent of the photosensitive drum on the photosensitive drum to the first end is identical with a direction of a velocity vector of the photosensitive drum in the point of tangency while the photosensitive drum is rotated, the second end is above the first end, and the point of tangency of the first tangent on the photosensitive drum is above a horizontal line passing through a center of the photosensitive drum, and wherein an entire region of the brush portion is continuously arranged in a second quadrant where a rotation axis of the charging roller is an origin, a vertical direction is a Y-axis direction, and a horizontal direction is a X-axis direction from start of an image formation to end of the image formation.

2. The cartridge according to claim 1, wherein, when the cartridge is inserted into the apparatus main body, a tangent passing through a contact point between the charging roller and a central part of the abutment region of the brush portion is a second tangent, and, among four regions divided by the first and second tangents crossing each other, a region including the charging roller is a first region, the regions other than the first region are second, third, and fourth regions in a direction identical to the rotation direction of the charging roller, the cartridge is inserted into the apparatus main body in a direction toward the first or third region.

3. The cartridge according to claim 1, wherein in the section perpendicular to a rotation axis of the charging roller in a state where the cartridge is mounted to the apparatus main body, the first end is above the horizontal line passing through a center of the rotation of the charging roller.

4. The cartridge according to claim 3, wherein, among angles formed by the horizontal line and a virtual line connecting a contact point between the charging roller and a central part of the abutment region of the brush portion and the center of the rotation of the charging roller, an angle α measured between the virtual line and the horizontal line in the rotation direction of the charging roller satisfies $0° < \alpha < 90°$.

5. The cartridge according to claim 4, wherein the angle α is 45°.

6. The cartridge according to claim 1, wherein, in the section perpendicular to a rotation axis of the charging roller in a state where the cartridge is mounted to the apparatus main body, among angles formed by a horizontal line passing through a center of the rotation of the photosensitive drum, and a virtual line connecting a contact point, which is formed between the first tangent and a surface of the photosensitive drum, and the center of the rotation of the photosensitive drum, an angle β measured between the horizontal line and the virtual line in the rotation direction of the photosensitive drum satisfies $0° < \beta < 90°$.

7. The cartridge according to claim 6, wherein the angle β is 30°.

8. The cartridge according to claim 1, wherein, in the section perpendicular to a rotation axis of the charging roller in a state where the cartridge is mounted to the apparatus main body, the second end is below a topmost part of the charging roller.

9. The cartridge according to claim 1, wherein, in the section perpendicular to a rotation axis of the charging roller in a state where the cartridge is mounted to the apparatus main body, a contact region between the charging roller and the photosensitive drum is below a horizontal line passing through a center of the rotation of the charging roller.

10. The cartridge according to claim 1, wherein, in the section perpendicular to a rotation axis of the charging roller in a state where the cartridge is mounted to the apparatus main body, the abutment region and a contact region between the charging roller and the photosensitive drum are on opposite sides across a vertical line passing through a center of the rotation of the charging roller.

11. The cartridge according to claim 1, wherein, in a the section perpendicular to a rotation axis of the charging roller in a state where the cartridge is mounted to the apparatus main body, a contact region between the charging roller and the photosensitive drum is arranged in a fourth quadrant where the rotation axis is the origin, the vertical direction is the Y-axis direction, and the horizontal direction is the X-axis direction.

12. The cartridge according to claim 1, which is used by an image forming apparatus which recovers, by a developing apparatus which develops an electrostatic latent image formed on the photosensitive drum, a toner untransferred to a material for transfer and remaining at the photosensitive drum.

13. The cartridge according to claim 12, wherein the cleaning member changes a polarity of the toner adhering to the charging roller by rubbing the toner so that the toner is recovered by the developing apparatus from the charging roller through the photosensitive drum.

14. The cartridge according to claim 1, wherein the cleaning member is applied with a voltage from a power supply in the apparatus main body so that a potential of the cleaning member is identical to a potential of the charging roller.

15. A cartridge, comprising:

a photosensitive drum which is rotatable and is provided in the cartridge, the cartridge being detachably provided to an apparatus main body of an image forming apparatus;

a charging roller which contacts and charges the photosensitive drum; and a cleaning member which cleans the charging roller, wherein the cleaning member has a brush portion, at least a part of the brush portion contacting a surface of the charging roller, and wherein, during an image formation, the cleaning member is continuously arranged such that the brush portion is at a position where a toner attached to the brush portion falls onto a surface of the photosensitive drum upstream of the charging roller in a rotation direction of the photosensitive drum.

16. A cartridge, comprising:

a photosensitive drum which is rotatable and is provided in the cartridge, the cartridge being detachably provided to an apparatus main body of an image forming apparatus;

a charging roller which contacts and charges the photosensitive drum; and a cleaning member which cleans the charging roller, wherein the cleaning member has a brush portion, at least a part of the brush portion contacting a surface of the charging roller, and wherein when the cartridge is mounted to the apparatus main body, the cleaning member is continuously arranged such that the brush portion is at a position where a toner attached to the brush portion falls onto a surface of the photosensitive drum upstream of the charging roller in a rotation direction of the photosensitive drum.

* * * * *